US007625236B1

(12) United States Patent
Wu

(10) Patent No.: US 7,625,236 B1
(45) Date of Patent: Dec. 1, 2009

(54) ELECTRICAL CONNECTOR HAVING REDUCED SIZE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,671

(22) Filed: Jun. 20, 2008

(51) Int. Cl.
*H01R 9/03* (2006.01)

(52) U.S. Cl. ..... 439/607.58

(58) Field of Classification Search ..... 439/607, 439/608, 610, 65, 108, 497, 941; 361/803; 174/261
See application file for complete search history.

(56) References Cited

U.S. PATENT DOCUMENTS 6,319,061 B1 * 11/2001 Chen et al. ..... 439/607
6,336,827 B1 * 1/2002 Akama et al. ..... 439/610
6,461,169 B1 * 10/2002 Harrison et al. ..... 439/65
6,685,511 B2 * 2/2004 Akama et al. ..... 439/610
7,341,487 B2 3/2008 Wu
7,448,917 B2 * 11/2008 Liao et al. ..... 439/660
2004/0067680 A1 * 4/2004 Wu ..... 439/497
2006/0134946 A1 * 6/2006 Vermeersch et al. ..... 439/76.1
2008/0207021 A1 * 8/2008 Hsu et al. ..... 439/79

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

An electrical connector (100) includes a connector housing (1), a plurality of contacts (2) received in the connector housing, a PCB (3) having a row of first conductive pads (34) and a row of second conductive pads (35), and a cable having a plurality of conductors. The first conductive pads and the second conductive pads are formed on two opposite surfaces of the PCB in a back to back relation. The conductors of the cable connect with the first conductive pads and the second conductive pads connect with the contacts.

7 Claims, 9 Drawing Sheets

ELECTRICAL CONNECTOR HAVING REDUCED SIZE

BACKGROUND OF THE INVENTION

1. Field of the Invention

The present invention relates generally to electrical connectors, and more particularly to an electrical connector for transmitting high-speed signals in an interconnection system.

2. Description of Related Arts

Cable end connector usually has electrical contacts electrically interconnecting with both conductors of an electrical cable and electrical contacts of a complementary electrical connector to transmit signals therebetween. Universal Serial Bus (USB) cable end connectors are widely used in portable electronic devices.

A portable electronic device needs to incorporate as many electronic components therein as possible on one hand for multi-function and to get smaller and smaller on the other hand for portability. Thus, electrical connectors such as USB cable end connectors accommodated in the portable electronic device to connect peripheral electronic components, which are not put in the portable electronic device, to the portable electronic device are made as small as possible to comply with the miniature of the device.

However, a kind of USB cable end connector found in a daily use usually comprises a printed circuit board (PCB) which has a plurality of first conductive pads formed on one of the two surfaces thereof and a plurality of second conductive pads on the two surfaces and the second conductive pads are especially on an opposite end to the first conductive pads. The USB cable end connector further comprises a plurality of contacts connecting with the first pads and a cable having conductors connecting with the second pads. For the contacts and the conductors are respectively located on the opposite ends of the PCB, much space is wasted.

Hence, an improved electrical connector having minimized space is desired.

SUMMARY OF THE INVENTION

Accordingly, an object of the present invention is to provide an electrical connector having minimized space.

To achieve the above object, an electrical connector includes a connector housing, a plurality of contacts received in the connector housing, a PCB having a row of first conductive pads and a row of second conductive pads, and a cable having a plurality of conductors. The first conductive pads and the second conductive pads are formed on two opposite surfaces of the PCB in a back to back relation. The conductors of the cable connect with the first conductive pads and the second conductive pads connect with the contacts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
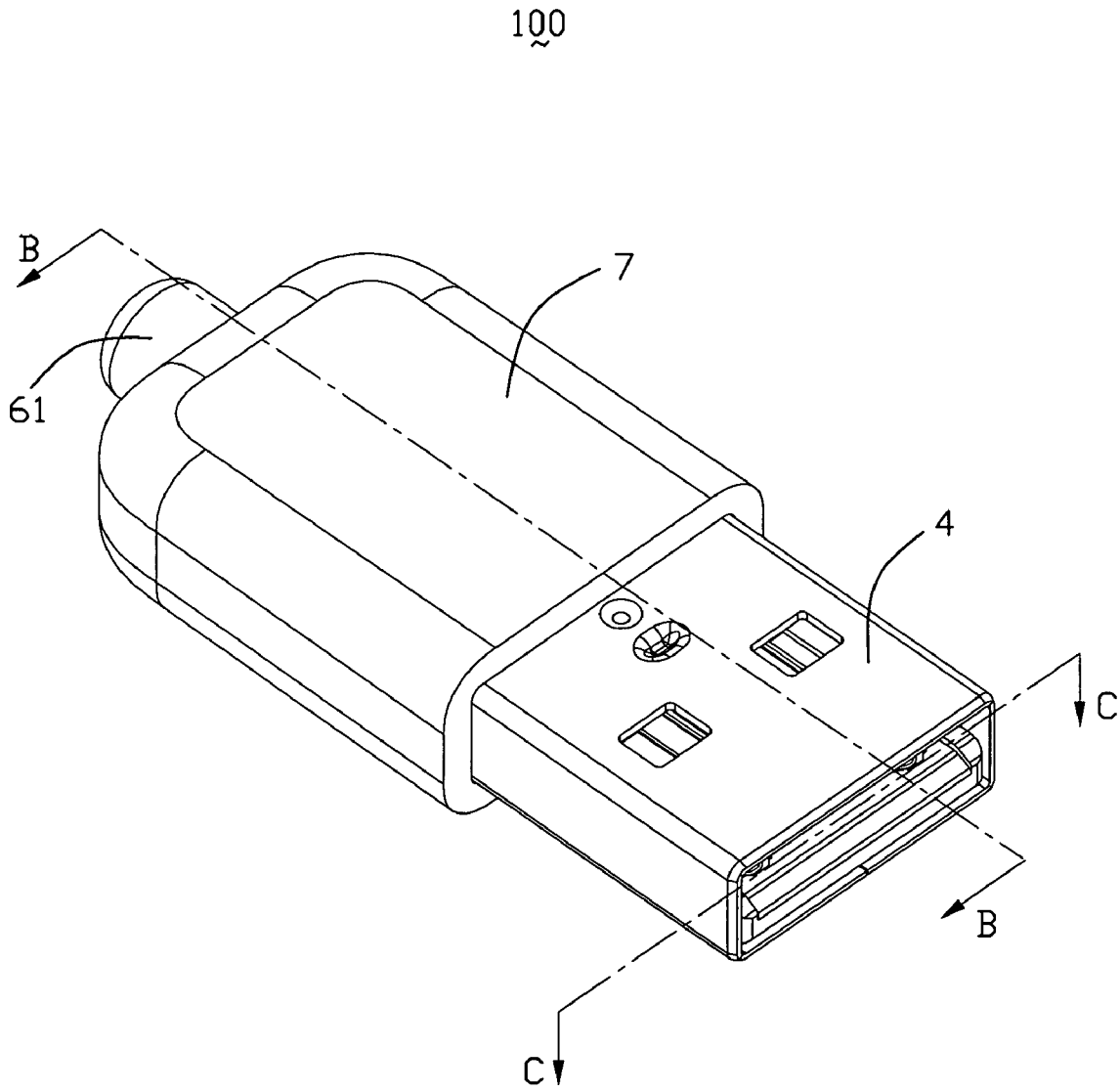
FIG. 1 is a perspective, assembled view of an electrical connector according to the present invention.

FIGS. 1-9 illustrate an electrical connector 100 in accordance with the present invention defining a mating direction and a mating interface, and comprising a connector housing 1, a plurality of contacts 2 received in the connector housing 1, a PCB 3 attached to the connector housing 1 and electrically connected to the contacts 2, a cable (not shown) having conductors electrically connected to the PCB 3 too, a first metal shell 4 associating with a second metal shell 5 for covering the connector housing 1 to define a receiving space, a strain relief 6 insert molded therein and a cover 7 formed peripherally for providing a sheath.

Figure 2:
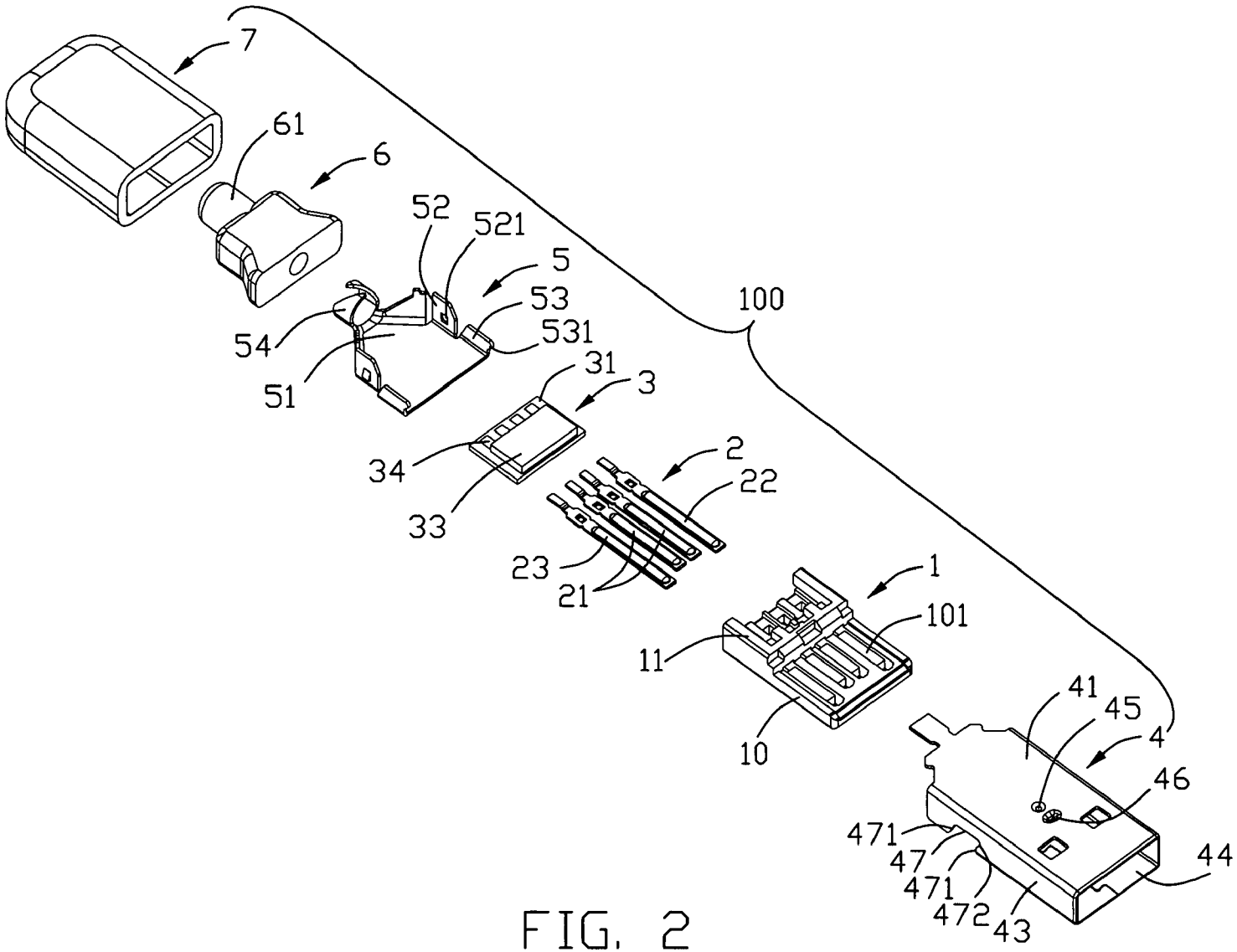
FIG. 2 is a perspective, exploded view of the electrical connector.
Figure 3:
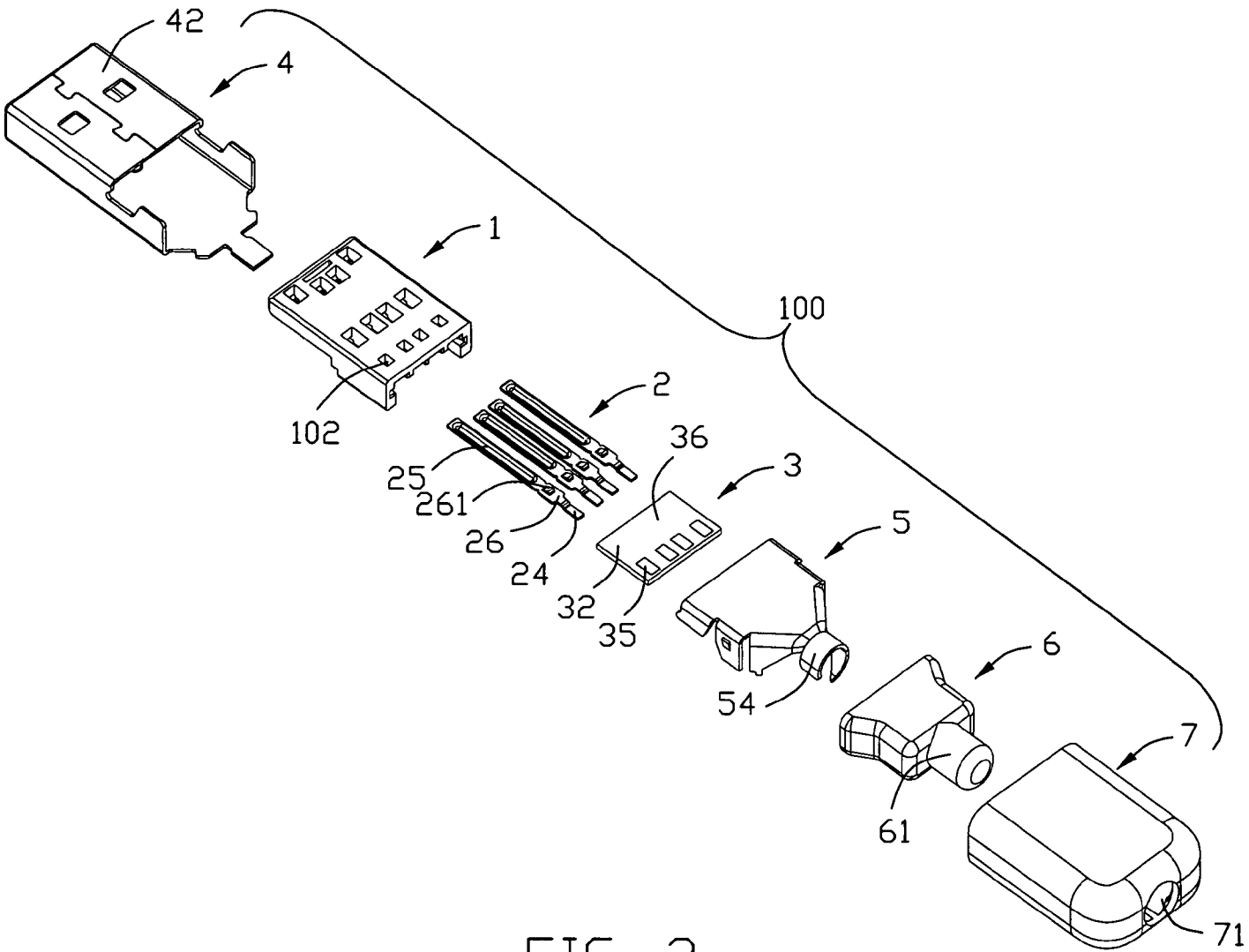
FIG. 3 is a view similar to FIG. 2, but taken from a different aspect.
Figure 4:
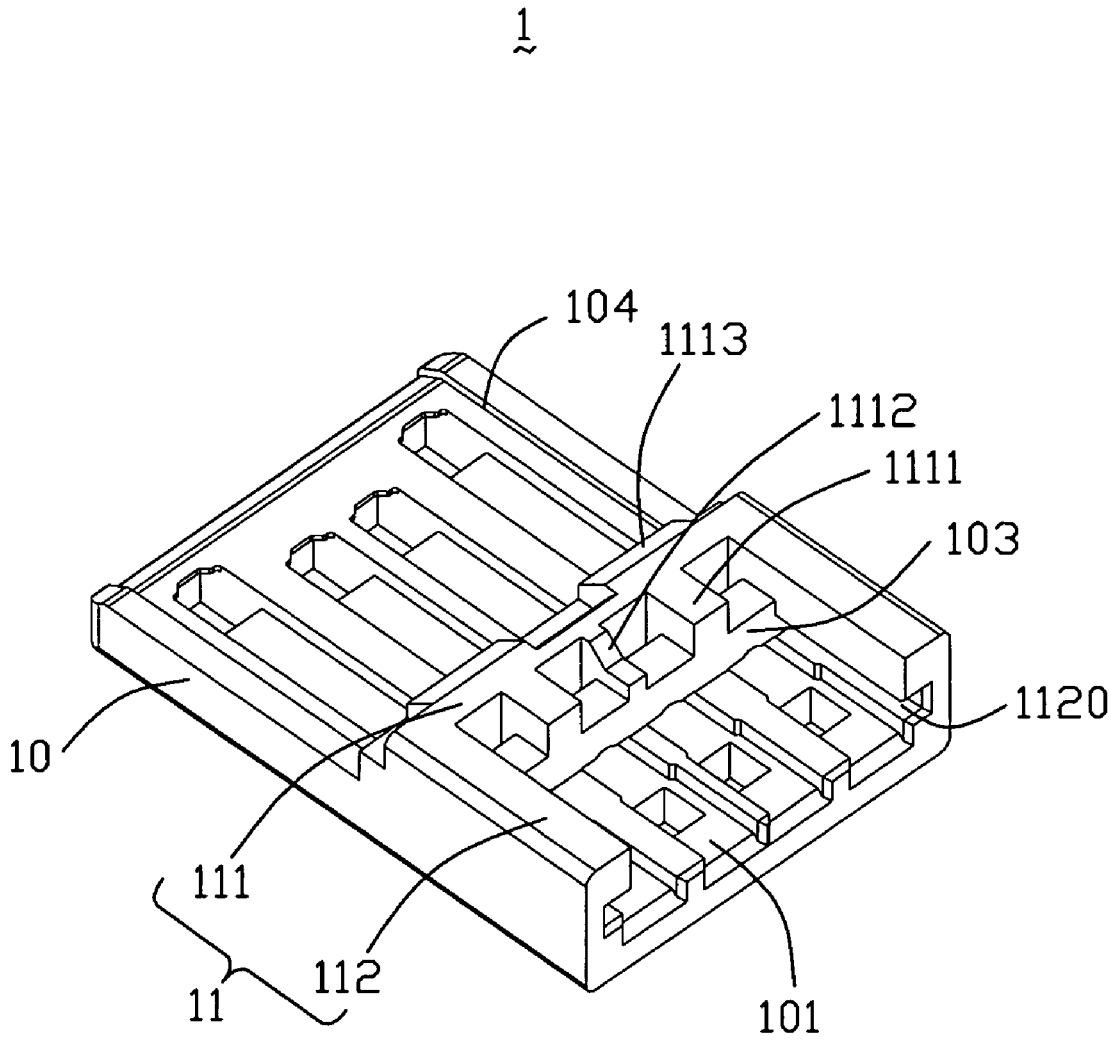
FIG. 4 is a view of the connector housing of the present invention.
Figure 5:
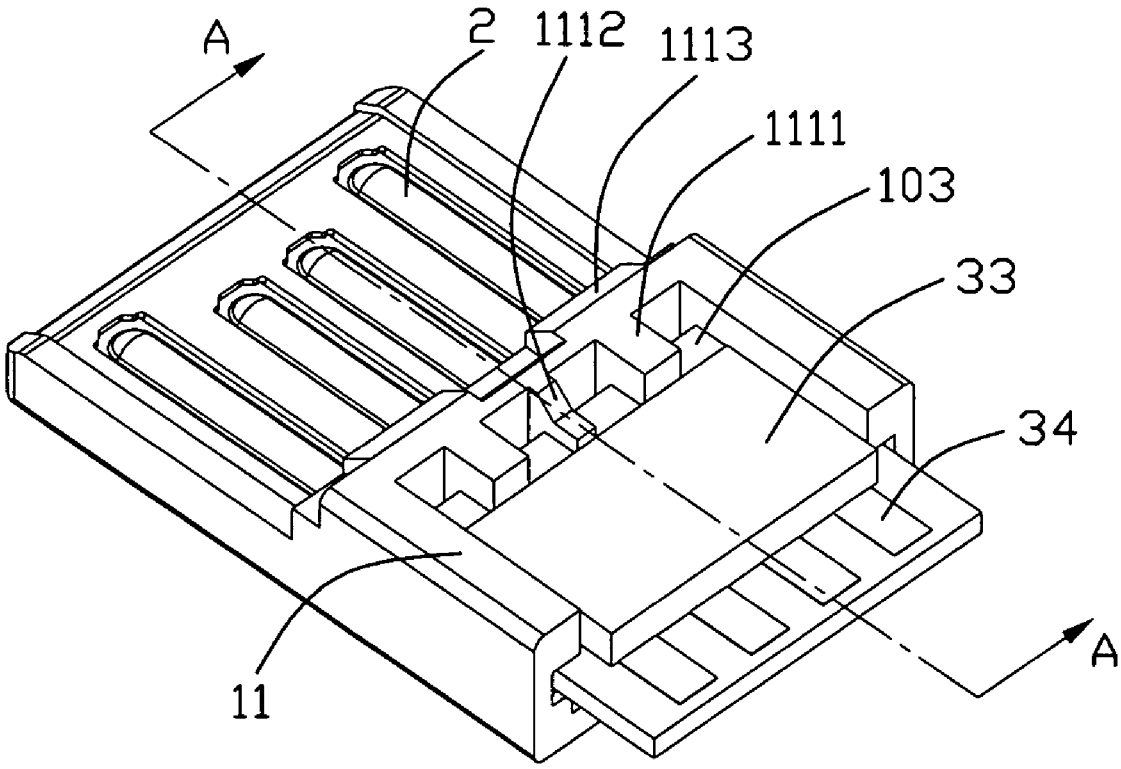
FIG. 5 is a perspective, assembled view of the connector housing, the contacts and the PCB.
Figure 6:
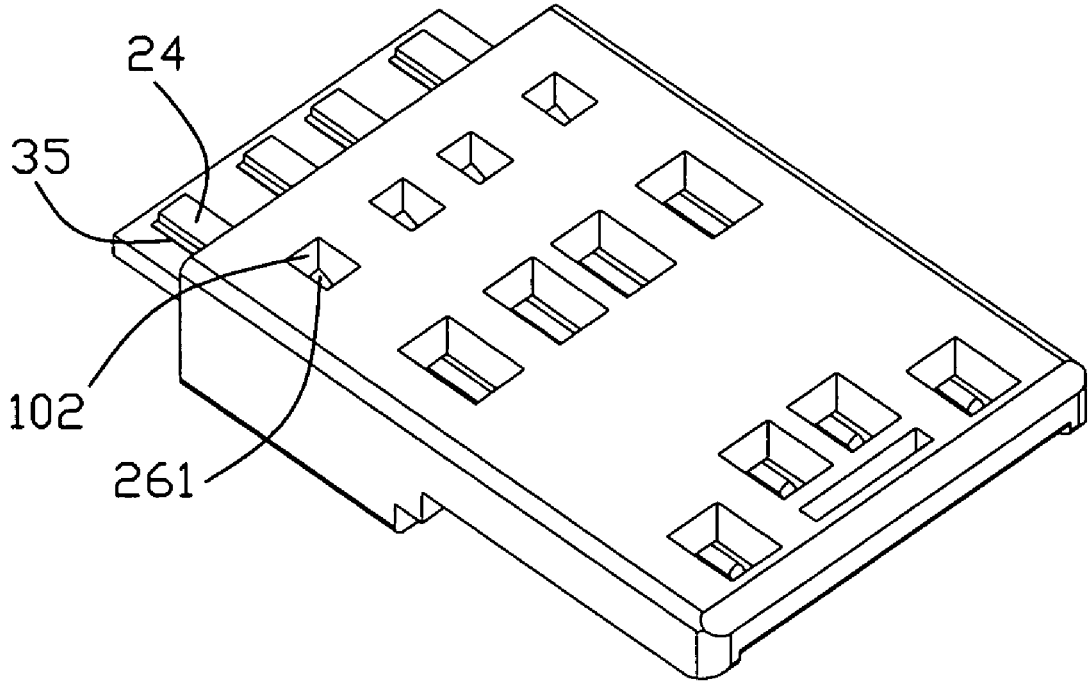
FIG. 6 is a view similar to FIG. 5, but taken from a different aspect.
Figure 7:
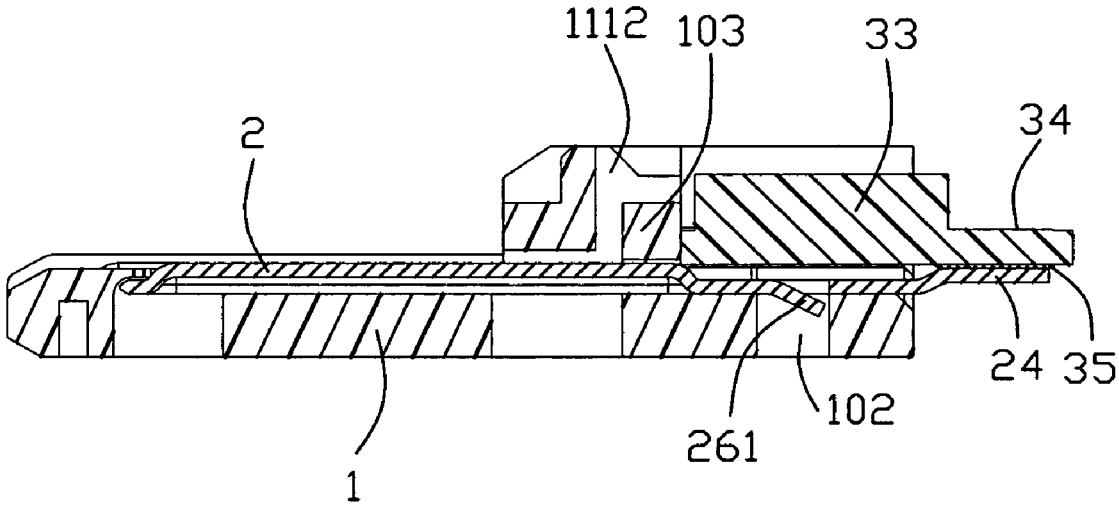
FIG. 7 is a cross-sectional view of FIG. 5 taken along line A-A.
Figure 8:
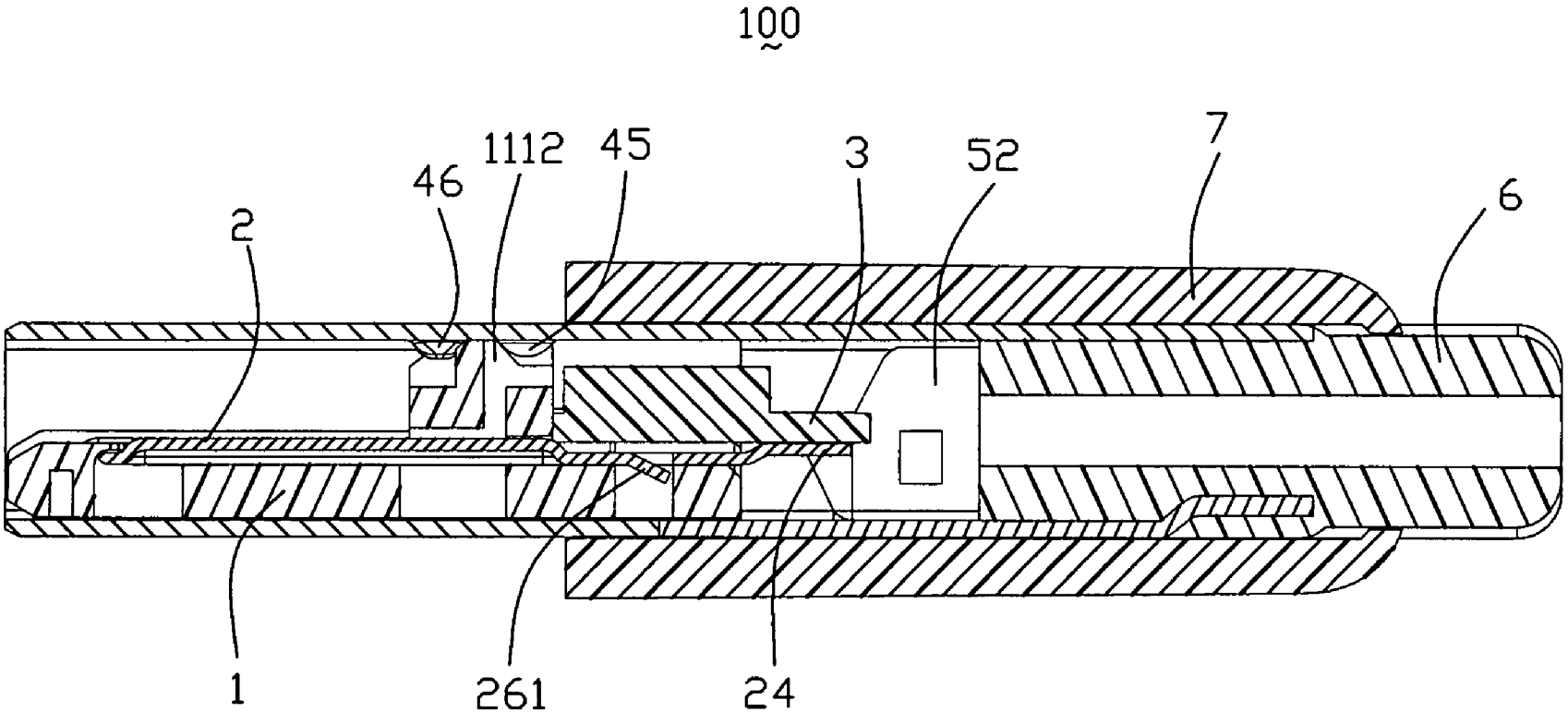
FIG. 8 is a cross-sectional view of FIG. 1 taken along line B-B.
Figure 9:
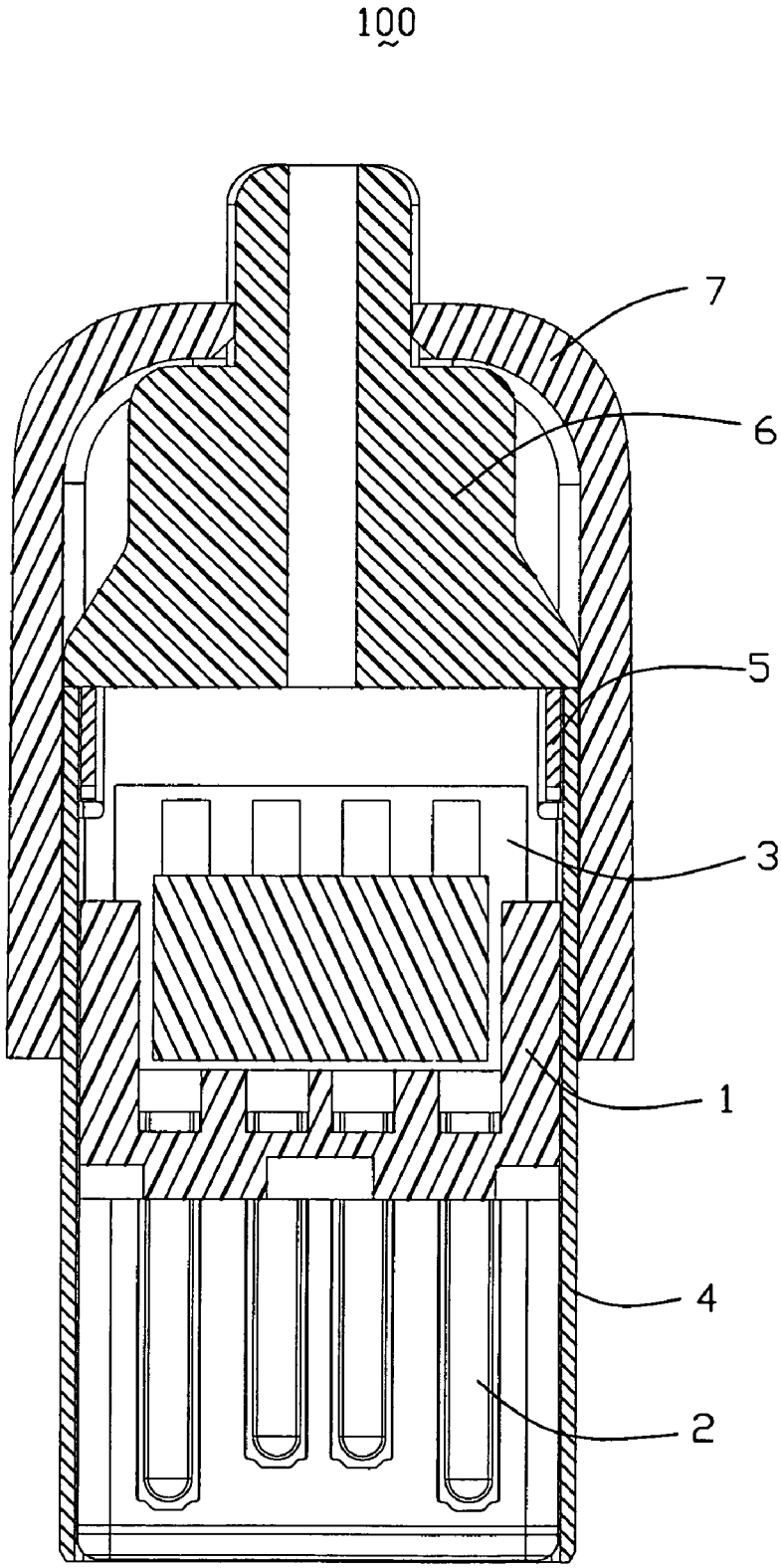
FIG. 9 is a cross-sectional view of FIG. 1 taken along line C-C.

Referring to FIGS. 2-4, the connector housing 1 comprises a base portion 10 and a U-shaped portion 11 integrally formed with the base portion 10 at a rear part thereof. The base portion 10 defines a plurality of parallel channels 101 for receiving the contacts 2 and a row of through holes 102 for locking with the contacts 2. The U-shaped portion 11 defines a receiving room for the PCB 3 and comprises a traverse arm 111 located at a middle part of base portion 10 and a pair of longitudinal arms 112 extending rearward from two ends of the traverse arm 111. Each longitudinal arm 112 associates with the base portion 10 for defining a guiding slot 1120. The traverse arm 111 comprises a pair of protrusions 1111 extending backwards to the receiving room for the PCB 3, a stepped portion 1112 located between the protrusions 1111 and extending into the receiving room for the PCB 3 too and a pair of slopes 1113 formed at an opposite side thereof relative to the protrusions 1111. The base portion 10 comprises a baffle portion 103 seated just under the traverse arm 111 of the U-shaped portion 11 for confrontment with the PCB 3. The base portion 10 further comprises a pair of ribs 104 formed at a front part thereof for reliable connection with a mating connector (not shown).

Referring to FIGS. 2 and 3, a number of the contacts 2 is four, a pair of which in the middle is signal pins 21 for transmitting high-speed signals, a power pin 22 and a grounding pin 23 are respectively located beside one of the signal pins 21. The distance between the signal pins 21 is closer than the distance between the power pin 22 and the adjacent signal pin 21 as well as the distance between the grounding pin 23 and the other signal pin 21. Each contact 2 comprises a soldering portion 24 electrically connected with the PCB 3, a contact portion 25 hunching upwardly for effectively contacting with the mating connector and a connecting portion 26 connecting the soldering portion 24 and the contact portion 25. The connecting portion 26 comprises an elastic piece 261 for locking purpose.

Referring to FIGS. 2 and 3, the PCB 3 is shaped in a rectangular piece having an upper surface 31 and a lower surface 32. A plurality of first conductive pads 34 for connecting with the conductors of the cable and a plurality of second conductive pads 35 for connecting with the soldering portions 24 of the contacts 2 are formed on two opposite surfaces of the PCB 3, in a preferred embodiment, the first and second conductive pads 34, 35 are located in a back to back relation. On the upper surface 31, an electrical module 33 composed by a plurality of electronic elements (not shown) is electrically mounted there at the other end opposite to the first conductive pads 34 for eliminating noise. On the lower surface 32, just under the electrical module 33, copper pieces 36 are attached thereon for grounding purpose.

Referring to FIGS. 2-3, the first metal shell 4 comprises a top wall 41, a bottom wall 42 and lateral walls 43 connecting the top wall 41 with the bottom wall 42 for defining an interspace (not labeled) to receive the connector housing 2 and then, a rectangular inserting port 44 is defined for the mating connector inserting into. The top wall 41 forms a pair of concave portions 45, 46 along the mating direction. Each lateral wall 43 defines a cutout 47 at an end distant away from the inserting port 44. The cutout 47 has two slippery edges 471 and a locking portion 472 at a free end thereof. The second metal shell 5 comprises a bottom shield 51, a pair of sidewalls 52 and a pair of latches 53, being aligned with each other, both extending upward from two edges of the bottom shield 51. Each latch 53 comprises a flange 531 protruding into the locking portion 472 of the first metal shell 4. The distance between the sidewalls 52 is smaller than the distance between the lateral walls 43 in a cross direction relative to the mating direction so that the sidewalls 52 lean against the inner surfaces of the lateral walls 43 for mating purpose and a block 521 is formed on each sidewall 52 for engagement purpose. The second metal shell 5 further comprises a loop 54 at a rear part thereof.

Referring to FIGS. 2-3, the strain relief 6 is insert molded the cable and comprises a tube 61 previously molded for receiving the cable.

Referring to FIGS. 2-3, the cover 7 shaped in a cap is previously molded for providing a sheath. The cover 7 defines an aperture 71 for the cable passing through.

Referring to FIGS. 5-9, in assembly, the conductors of the cable and the soldering portions 24 of the contacts 2 are firstly and respectively soldered onto the first and second conductive pads 34, 35 of the PCB 3. Then, the PCB 3 is inserted into the receiving room defined by the U-shaped portion 11 under the guidance of the guiding slot 1120, until the front edge of the PCB 3 confronts the baffle portion 103 for preventing the PCB 3 from being inserted excessively, the contacts 2 are fitly received in the channels 101, and the contacts 2 are prevented from being pulled out of the channels 101, because each elastic piece 261 of the connecting portion 26 is locked in the through hole 102 of the connector housing 1. Next, the first metal shell 4 shields over the connector housing 1 along a front-to-rear direction, in the beginning, two of the concave portions 45, 46 are both at a mating side of the stepped portion 1112, when the first metal shell 4 farther moves onto the connector housing 1, the first concave portion 45 goes across the stepped portion 1112 and the stepped portion 1112 is fixedly located between the first and second concave portions 45, 46 and accordingly, the first metal shell 4 is firmly fastened on the connector housing 1. Following, the second metal shell 5 is then firmly attached to the first metal shell 4 by the sidewalls 52 leaning against the inner surfaces of the lateral walls 43, and synchronously, the flange 531 of each latch 53 engaging with the locking portion 472 of the cutout 47. After the cable is enveloped by the tube 61, which is previously molded, the strain relief 6 is insert molded therein. At last, the cover 7 shields over peripherally for protection purpose.

In the present invention, for the PCB 3 comprises a plurality of first conductive pads 34 for connecting with the conductors of the cable and a plurality of second conductive pads 35 for connecting with the soldering portions 24 of the contacts 2 formed on two opposite surfaces thereof, and the first and second conductive pads 34, 35 are located just in a back to back station, so, an electrical connector 100 having minimized space is achieved.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical connector comprising:

an insulative housing defining a front mating port and a rear connection port;

a plurality of contacts disposed in the housing, each of said contacts including a contacting section extending into the mating port and a connection section extending into the connection port;

a printed circuit board (PCB) located in the connection port and defining opposite first and second surfaces thereon and a rear edge thereof;

an electrical module located upon the first surface;

the connection section soldered to a first row of conductive pads of the second surface around the rear edge;

a cable located behind the connection port and having a plurality of conductors soldered to a second row of conductive pads of the first surface around the rear edge, the first and second rows of conductive pads arranged in a back to back relation;

a shell enveloping the insulating housing; and a cover molded over the shell and partly enclosing a rear of the shell.

2. The electrical connector as described in claim 1, wherein the contacts consist of a pair of signal pins and a power pin and a grounding pin respectively disposed at the opposite sides of the two signal pins.

3. The electrical connector as described in claim 2, wherein the insulative housing forms a baffle portion confronting with the PCB in a transverse direction and defines a pair of guiding slots at opposite sides thereof for guiding the PCB.

4. An clerical connector comprising:

an insulative housing defining a front mating port and a rear connection port;

a plurality of contacts disposed in the housing, each of said contacts including a contacting section extending into the mating port and a connection section extending into the connection port;

a printed circuit board located in the connection port and defining opposite first and second surfaces thereon and a rear edge thereof;

an electrical module located upon the first surface;

a cable located behind the connection port and having a plurality of conductors soldered respectively to a plurality of conductive pads on the first surface around the rear edge; and the connection section soldered respectively to a plurality of conductive pads on the second surface around the rear edge.

5. The electrical connector as claimed in claim 4, wherein the connection port of said housing defines a pair of guiding slots to receive the printed circuit board and the associated electronic module.

6. The electrical connector as claimed in claim 4, wherein the connection port of the housing defines a plurality of holes into which elastic pieces of the corresponding contacts extend for locking the corresponding contacts in position in the housing under condition that elastic pieces of the contacts are protectively hidden under the printed circuit board.

7. The electrical connector as claimed in claim 4, wherein a first area defined by said plurality of first conductive pads is essentially aligned, in a vertical direction, with a second area defined by said plurality of second conductive pads.

* * * * *